United States Patent [19]

Geytenbeek

[11] 3,979,628

[45] Sept. 7, 1976

[54] METHOD OF MANUFACTURING AN ELECTRODE PROVIDED WITH CONNECTION

[75] Inventor: Johannes Jacobus Franciscus Geytenbeek, Eindhoven, Netherlands

[73] Assignee: U.S. Philips Corporation, New York, N.Y.

[22] Filed: Sept. 25, 1974

[21] Appl. No.: 509,140

[30] Foreign Application Priority Data

Oct. 4, 1973 Netherlands ..... 7313627

[52] U.S. Cl. ..... 313/331; 29/25.13; 29/25.14; 313/271; 313/333

[51] Int. Cl.[2] ..... H01J 5/50

[58] Field of Search ..... 313/331, 332, 333, 271, 313/272, 344, 273; 29/25.15, 25.13, 25.14

[56] References Cited

UNITED STATES PATENTS

| | | | |
|---|---|---|---|
| 2,961,568 | 11/1960 | Pertwee | 313/271 |
| 3,189,778 | 6/1965 | Brundige | 313/331 |
| 3,423,622 | 1/1969 | Rowe | 313/271 X |
| 3,812,393 | 5/1974 | Koo et al. | 313/344 |

*Primary Examiner*—Saxfield Chatmon, Jr.
*Attorney, Agent, or Firm*—Frank R. Trifari

[57] ABSTRACT

A method of manufacturing an electrode provided with a connection conductor for a gas and/or vapor discharge lamp. A quantity of electrically conducting auxiliary material, having a melting point less than the turns, is introduced between several turns of the electrode. Subsequently this assembly is heated to above the melting point of the auxiliary material below the melting point of the material of the turns. Cooling takes place after auxiliary material has flowed between the turns. Subsequently the auxiliary material is connected to the actual connection conductor which may be a bushing shaped lead-through conductor.

3 Claims, 4 Drawing Figures

METHOD OF MANUFACTURING AN ELECTRODE PROVIDED WITH CONNECTION

The invention relates to a method of manufacturing an electrode provided with an electric connection conductor for a gas and/or vapour discharge lamp in which the electrode is provided with a piece of wire consisting of at least several turns of a material conducting electricity, the melting point of the material of the connection conductor being lower than that of the piece of wire, the connection conductor extending at least partly into the turns and then secured thereto. The invention also relates to an electrode povided with a connection conductor manufactured by this method.

A known method of the kind mentioned above is described in, for example, United Kingdom Patent Specification No. 565,689.

In this known method the connection of the connection conductor to the turns is a clamping connection. A drawback thereof is that the electrical contact has a relatively poor quality and that furthermore the connection might be interrupted due to mechanical vibrations etc.

An object of the invention is to obviate or at least mitigate the said drawbacks.

According to the invention a method of manufacturing an electrode provided with an electric connection conductor for a gas and/or vapour discharge lamp in which the electrode is provided with a piece of wire having at least several turns of a material conducting electricity and in which the melting point of the material of the connection conductor is lower than that of the piece of wire and in which the connection conductor is partially disposed within the turns and then secured thereto. The connection conductor is secured to the turns of the piece of wire by heating the connection conductor at the area of the turns to a temperature which is between the melting point of the connection conductor and that of the piece of wire giving the material of the connection conductor the possibility of flowing between the turns of the piece of wire, whereafter cooling takes place.

An advantage of a method according to the invention is that the electrical contact between the connection conductor and the turns of the wire piece is very satisfactory and that the connection conductor is secured to the turns substantially undetachably.

The connection conductor consists of, for example, a rod having a length which is several times larger than the length of the wire piece measured along the centre line of the turns. In this case only the peak of the rod projecting into the turns need be heated to above its melting point.

The connection conductor may have the same cross-section throughout or may have a different shape, for example, a conical shape. In the latter case the tip of the cone is connected to the turns during the method.

In a method according to the invention in which the connection conductor has a part on the side remote from the turns whose cross-section deviates from the cross-section of the connection conductor at the area of the turns, the part of the connection conductor having the deviating cross-section is secured to the part of the connection conductor projecting into the turns only after the latter connection conductor part is secured to the turns.

An advantage of this preferred method is that also for a short distance between the turns and the connection conductor part with a deviating cross-section a tight construction becomes possible and this because the connection conductor part sealed to the turns can ensure a very satisfactory connection with the connection conductor part of deviating cross-section. Without this auxiliary connection conductor part between the turns a connection of the turns to the connection part of deviating cross-section would generally be less tight.

In a further improvement of the said preferred embodiment the same material is used for the material of the two parts of the connection conductor.

An advantage of this further improvement is that the two connection conductor parts may be very simply, connected together, for example, by welding.

In this case the connection conductor parts are both made of, for example, molybdenum. The turns are made of, for example, tungsten having a melting point which is approximately 800°C higher than that of molybdenum.

Preferably in a method according to the invention during heating of the part of the connection conductor projecting into the turns such a quantity of the material of this connection conductor is allowed to flow about a turn of the wire piece that at least 40% of the surface of this turn is narrowly enclosed by this connection conductor. This is achieved, for example, by heating this connection conductor part to above its melting point for such a period that this material can freely flow between the turns. A mechanically strong and also electrically satisfactory connection is then obtained.

A gas and/or vapour discharge lamp whose combination of an electrode and a connection conductor is made in accordance with the latter preferred method according to the invention preferably has such a connection conductor of the electrode which is solid within the turns of this electrode and is formed as a hollow cylinder outside these turns constituting a lead-through conductor through a wall of the discharge space of the lamp.

An advantage of this lamp is that a tight electrode connection construction is accompanied by a lead-through through the wall of the discharge space which due to the hollow cylindrical form is very suitable for taking up forces, for example, caused by differences in coefficient of expansion. This embodiment has advantages especially for high-pressure lamps.

The invention will be described in greater detail with reference to a drawing.

Figure 1:
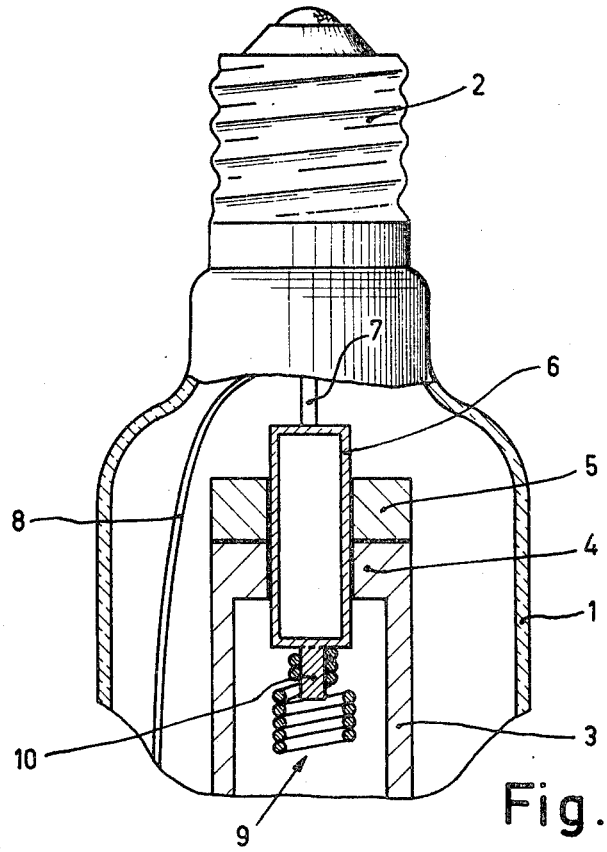
FIG. 1 is a longitudinal section partly elevational view through an end part of a discharge lamp according to the invention.

In FIG. 1 the reference numeral 1 denotes a part of an outer envelope of a high-pressure sodium lamp. Reference numeral 2 is the lamp cap. Reference numeral 3 denotes a discharge tube of densely sintered aluminium oxide an end of which is provided with a ring 4 sintered in that tube 4. The reference numeral 5 denotes a cover and 6 is a bush-shaped or bushing shaped lead-through conductor of molybdenum. A conductor 7 connects the lead-through conductor 6 to the lamp cap 2. 8 denotes a further conductor which connects the lamp cap 2 within the outer envelope 1 to the end (not shown) of the discharge tube 3. 9 is an electrode consisting of a wire piece of several turns of tungsten. The turns having the smallest diameter comprise a solid part 10 of molybdenum welded to the disc-shaped boundary part of the cylinder 6. The sealing construction of the discharge tube 3 shows some similarity with that described in Netherlands Patent Application No. 6704681. The lead-through material in this description was, however, of niobium instead of molybdenum.

Figure 2:
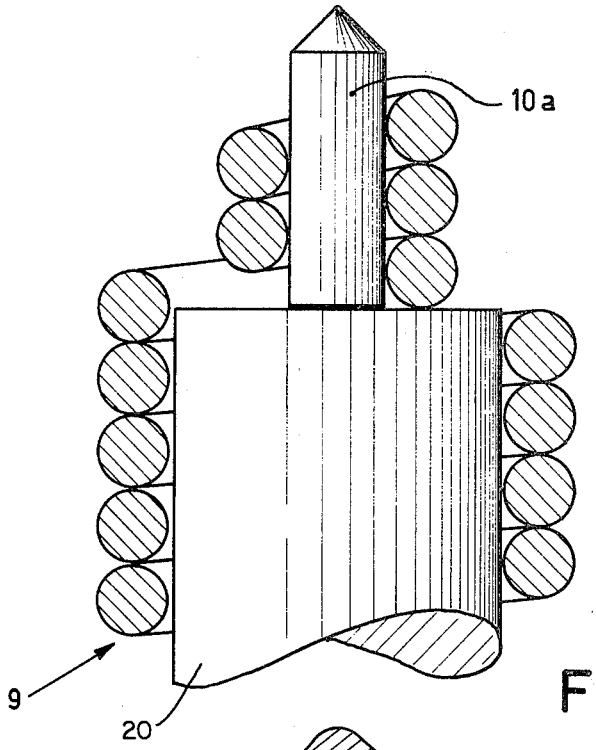
FIG. 2 is a first stage of a method according to the invention for manufacturing a combination of an electrode and a connection conductor for the lamp of FIG. 1.

FIG. 2 shows on a larger scale the electrode 9. This electrode is temporarily placed on a holder 20 of tungsten. A molybdenum pin 10*a* is placed in the turns of small diameter of the electrode 9. The pin 10*a* is slightly longer than the electrode part in which this pin has been placed.

Subsequently the molybedunum part 10*a* with its direct ambiance is heated for approximately 3 to 4 seconds at approximately 2800°C by means of a heating device not further shown, for example, a hydrogen burner. This temperature is above the melting point of molybdenum (2610°C) but below the melting point of tungsten (3410°C). The material of part 10*a* then flows between the turns of the electrode 9.

Figure 3:
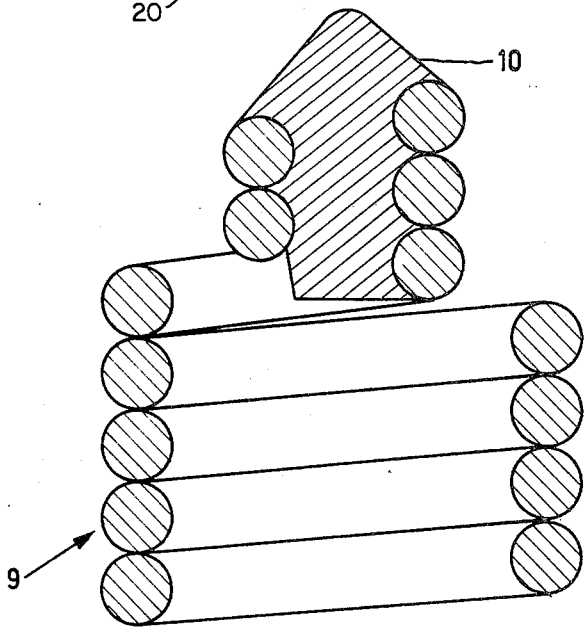
FIG. 3 shows a second stage of the method according to the invention for manufacturing a combination of an electrode and a connection conductor for the lamp of FIG. 1.

The situation then obtained (with the tungsten holder 20 being removed) is shown in FIG. 3.

Figure 4:
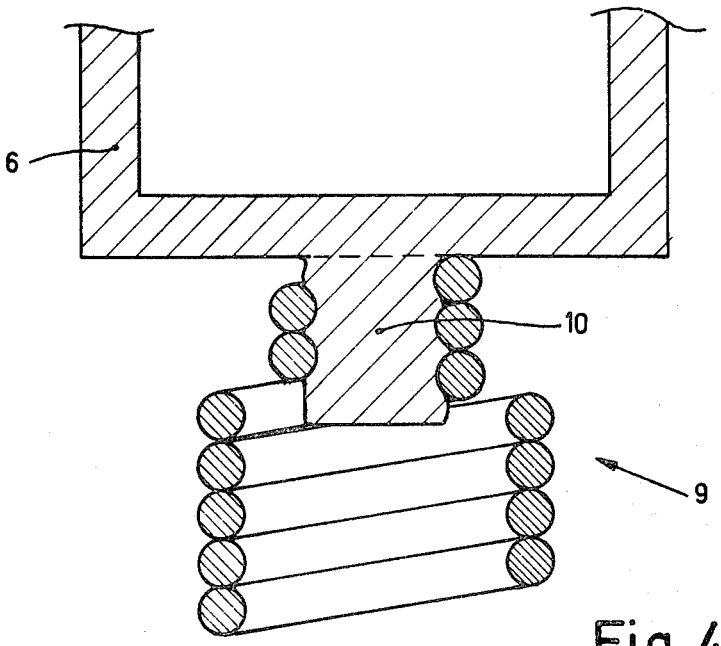
FIG. 4 shows a third stage of the method according to the invention for manufacturing a combination of an electrode and a connection conductor for the lamp of FIG. 1.

FIG. 4 shows how the assembly with part 10 shown in FIG. 3 is secured to the disc-shaped sealing part of the hollow cylinder 6 (see also FIG. 1). This is effected with the aid of a welding apparatus not shown.

The electrode connection construction 9, 10, 6 obtained was very tight. The bushing shape of the lead-through conductor 6 ensured a satisfactory resistance to expansion forces which may occur, for example, after ignition of the lamp.

What is claimed is:

1. A method of manufacturing a lamp having a generally helical electrode having a first melting point and an electrical connection conductor which comprises: providing a connection conductor having an elongated body of material having a second melting point lower than said first melting point, said body being formed for interfering engagement with the interior of said helix; positioning said elongated body within at least several turns of said helix; heating said connection conductor at the area of said several turns to a temperature intermediate said first melting point and said second melting point so that said connection conductor flows along the extent of the turns of the helical electrode engaging said body.

2. The method as described in claim 1 further including a final step of attaching an axially abutting extension to said elongated connection conductor after said heating step, said extension having a cross section different than said connection conductor.

3. A method as described in claim 2 wherein said connection conductor material is the same as the extension thereof.

* * * * *